US007328157B1

(12) United States Patent
Chu et al.

(10) Patent No.: US 7,328,157 B1
(45) Date of Patent: Feb. 5, 2008

(54) DOMAIN ADAPTATION FOR TTS SYSTEMS

(75) Inventors: Min Chu, Beijing (CN); Hu Peng, Beijing (CN)

(73) Assignee: Microsoft Corporation, Redmond, WA (US)

( * ) Notice: Subject to any disclaimer, the term of this patent is extended or adjusted under 35 U.S.C. 154(b) by 855 days.

(21) Appl. No.: 10/350,850

(22) Filed: Jan. 24, 2003

(51) Int. Cl.
*G10L 13/08* (2006.01)

(52) U.S. Cl. ..... 704/260; 704/266; 704/258

(58) Field of Classification Search ..... 704/245, 704/258, 259, 260, 265–266, 268–269, 261, 704/262, 267

See application file for complete search history.

(56) References Cited

U.S. PATENT DOCUMENTS 5,913,194 A * 6/1999 Karaali et al. ..... 704/259
6,665,641 B1 * 12/2003 Coorman et al. ..... 704/260
6,934,680 B2 * 8/2005 Holzapfel ..... 704/245
6,996,529 B1 * 2/2006 Minnis ..... 704/258

OTHER PUBLICATIONS

Gonnet, G.H., Baeza-Yates, R. A. and Sinder, T., "New Indices for Text: PAT Trees and PAT Arrays," *Information Retrieval: Data Structures and Algorithms*, Prentice Hall Press, New Jersey, pp. 66-82, 1992.

Morrison, D., "PATRICIA: Practical Algorithm to Retrieve Information Coded in Alphanumeric", JACM, pp. 514-534, 1968.

Chien, L.F., "PAT-tree-based Keyword Extraction for Chinese Information Retrieval", *Proceedings of the 20th annual international ACM SIGIR conference on research and development in information retrieval*, pp. 50-58, 1997.

* cited by examiner

*Primary Examiner*—Huyen X. Vo
(74) *Attorney, Agent, or Firm*—Westman, Champlin & Kelly, P.A.

(57) ABSTRACT

Embodiments of the present invention pertain to adaptation of a corpus-driven general-purpose TTS system to at least one specific domain. The domain adaptation is realized by adding a limited amount of domain-specific speech that provides a maximum impact on improved perceived naturalness of speech. An approach for generating optimized script for adaptation is proposed, the core of which is a dynamic programming based algorithm that segments domain-specific corpus into a minimum number of segments that appear in the unit inventory. Increases in perceived naturalness of speech after adaptation are estimated from the generated script without recording speech from it.

22 Claims, 10 Drawing Sheets

DOMAIN ADAPTATION FOR TTS SYSTEMS

BACKGROUND OF THE INVENTION

The present invention relates to speech synthesis. In particular, the present invention relates to adaptation of general-purpose text-to-speech systems to specific domains.

Text-to-speech (TTS) technology enables a computerized system to communicate with users utilizing synthesized speech. With newly burgeoning applications such as spoken dialog systems, call center services, and voice-enabled web and email services, increasing emphasis is put on generating natural sounding speech. The quality of synthesized speech is typically evaluated in terms of how natural or human-like are produced speech sounds.

Simply replaying a recording of an entire sentence or paragraph of speech can produce very natural sounding speech. However, the complexity of human languages and the limitations of computer storage make it impossible to store every conceivable sentence that may occur in a text. Instead, systems have been developed to use a concatenative approach to speech synthesis. This concatenative approach combines stored speech samples representing small speech units such as phonemes, diphones, triphones, syllables or the like to form a larger speech signal unit.

Concatenation based speech synthesis has been widely adopted and rapidly developed. To some extent, this type of speech synthesis involves collecting, annotating, indexing and retrieving speech units within large databases. Accordingly, it follows that the naturalness of the synthesized speech depends to some extent on the size and coverage of a given unit inventory. Due to the complexity of human languages and the limitations of computer storage and processing, generally expanding the unit inventory is not a particularly efficient way to increase naturalness of speech for a general-purpose TTS system. However, expanding the unit inventory is a reasonable method for increasing naturalness of a specific domain for a domain-specific TTS system.

The simplest way for generating speech prompt in domain-specific applications is to play back a collection of pre-stored waveforms for words, phrases and sentences. When the domain is narrow and closed, very natural speech prompt can be generated with this method at relatively low cost. However, when the domain is not closed or is broader, or when the number of domains increases, the cost for constructing and maintaining such prompt systems increases greatly.

A general-purpose TTS system is preferred instead. However, general-purpose TTS systems sometimes cannot generate high quality speech for some domains, especially when the domain mismatches the speech corpus that is used as the unit inventory. It would be desirable to have a general-purpose TTS system that can produce rather natural speech without domain restrictions and that can generate more natural speech for a specific domain after domain adaptation. Domain adaptation is a concept that has been explored in many research areas; however, few studies have been conducted in the context of TTS systems. Efficient domain adaptation of a general-purpose TTS can be accomplished through generation of an optimized script for collecting domain-specific speech.

SUMMARY OF THE INVENTION

Embodiments of the present invention pertain to adaptation of a corpus-driven general-purpose TTS system to at least one specific domain. The domain adaptation is realized by adding a limited amount of domain-specific speech that provides a maximum impact on improved perceived naturalness of speech. An approach for generating optimized script for adaptation is proposed, the core of which is a dynamic programming based algorithm that segments domain-specific corpus minimum number of segments that appear in the unit inventory. Increases in perceived naturalness of speech after adaptation are estimated from the generated script without recording speech from it.

DETAILED DESCRIPTION OF THE ILLUSTRATIVE EMBODIMENTS

I. Exemplary Operating Environments

Figure 1:
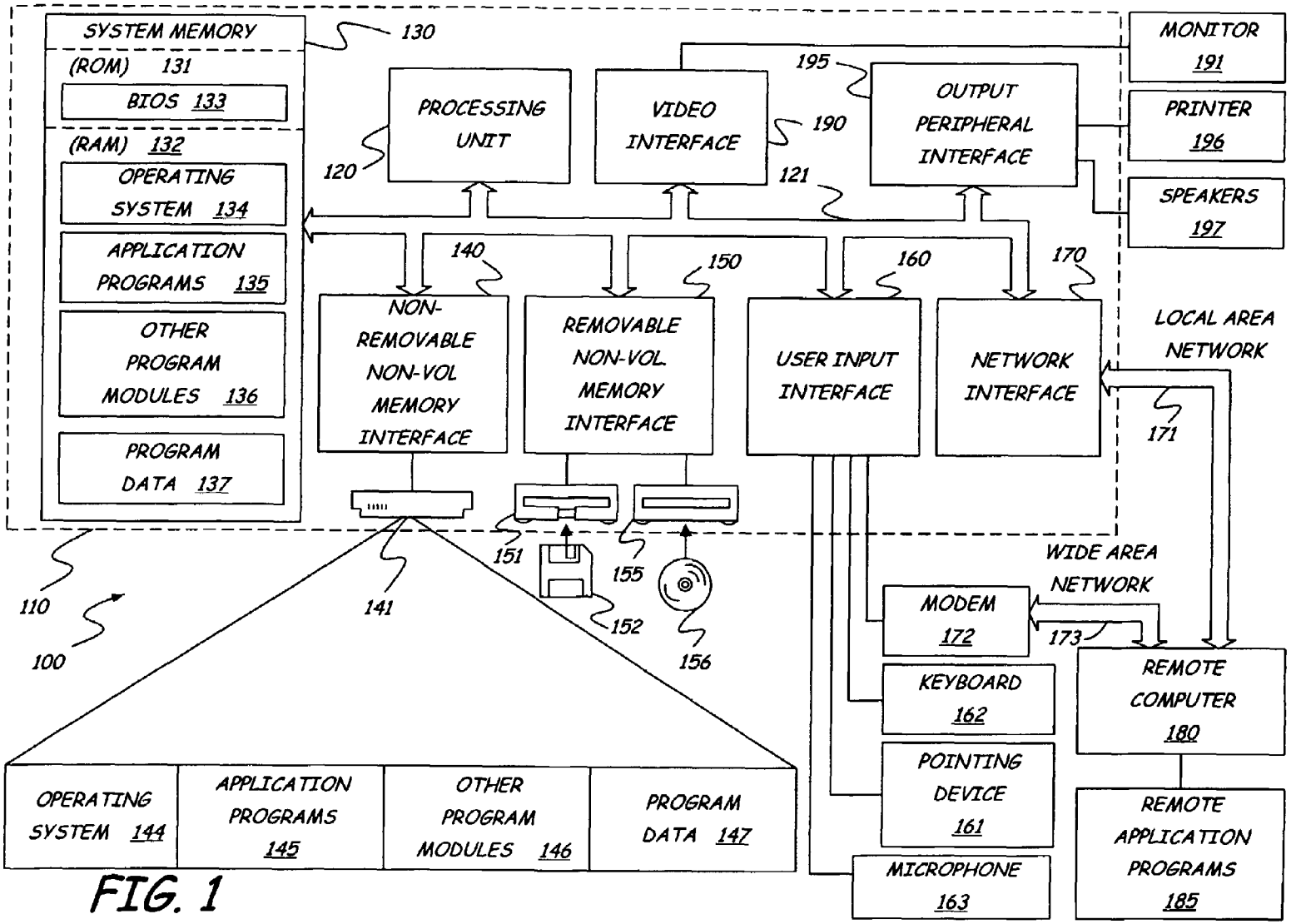
FIG. 1 is a block diagram of a general computing environment in which the present invention may be practiced.

FIG. 1 illustrates an example of a suitable computing system environment 100 on which the invention may be implemented. The computer system environment 100 is only one example of a suitable computing environment and is not intended to suggest any limitation as to the scope of use or functionality of the invention. Neither should the computing environment 100 be interpreted as having an dependency or requirement relating to any one or combination of components illustrated in the exemplary operating environment 100.

The invention is operational with numerous other general purpose or special purpose computing system environments or configurations. Examples of well known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices. Tasks performed by the programs and modules are described below and with the aid of figures. Those skilled in the art can implement the description and figures as processor executable instructions, which can be written on any form of a computer readable media.

With reference to FIG. 1, an exemplary system for implementing the invention includes a general-purpose computing device in the form of a computer 110. Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association, (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 100.

Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, FR, infrared and other wireless media. Combinations of any of the above should also be included within the scope of computer readable media.

The system memory 130 includes computer storage media in the form of volatile and/or nonvolatile memory such as read-only media (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD-ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136 and program data 137. Operating system 144, application programs 145, other program modules 146, and program data 147 are given different numbers here to illustrate that, at a minimum, they are different copies.

A user may enter commands and information into the computer 110 through input devices such as a keyboard 162, a microphone 163, and a pointing device 161, such as a mouse, trackball or touch pad. Other input devices (not shown) may include a joystick, game pad, satellite dish, scanner, or the like. These and other input devices are often connected to the processing unit 120 through a user input interface 160 that is coupled to the system bus, but may be connected by other interface and bus structures, such as a parallel port, game port, or a universal serial bus (USB). A monitor 191 or other type of display device is also connected to the system bus 121 via an interface, such as a video interface 190. In addition to the monitor, computers may also include other peripheral output devices such as speakers 197 and printer 196, which may be connected through an output peripheral interface 190.

The computer 110 may operate in a networked environment using logical connections to one or more remote computers, such as a remote computer 180. The remote computer 180 may be a personal computer, a hand-held device, a server, a router, a network PC, a peer device or other common network node, and typically includes many or all of the elements described above relative to the computer 110. The logical connections depicted in FIG. 1 include a local area network (LAN) 171 in a wide area network (WAN) 173, but may also include other networks. Such networking environments are commonplace in offices, enterprise-wide networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communication over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on the remote computer 180. It will be appreciated that the network connections shown are exemplary and other means of establishing a communications link between the computers may be used.

II. Exemplary Operational Context

Figure 2:
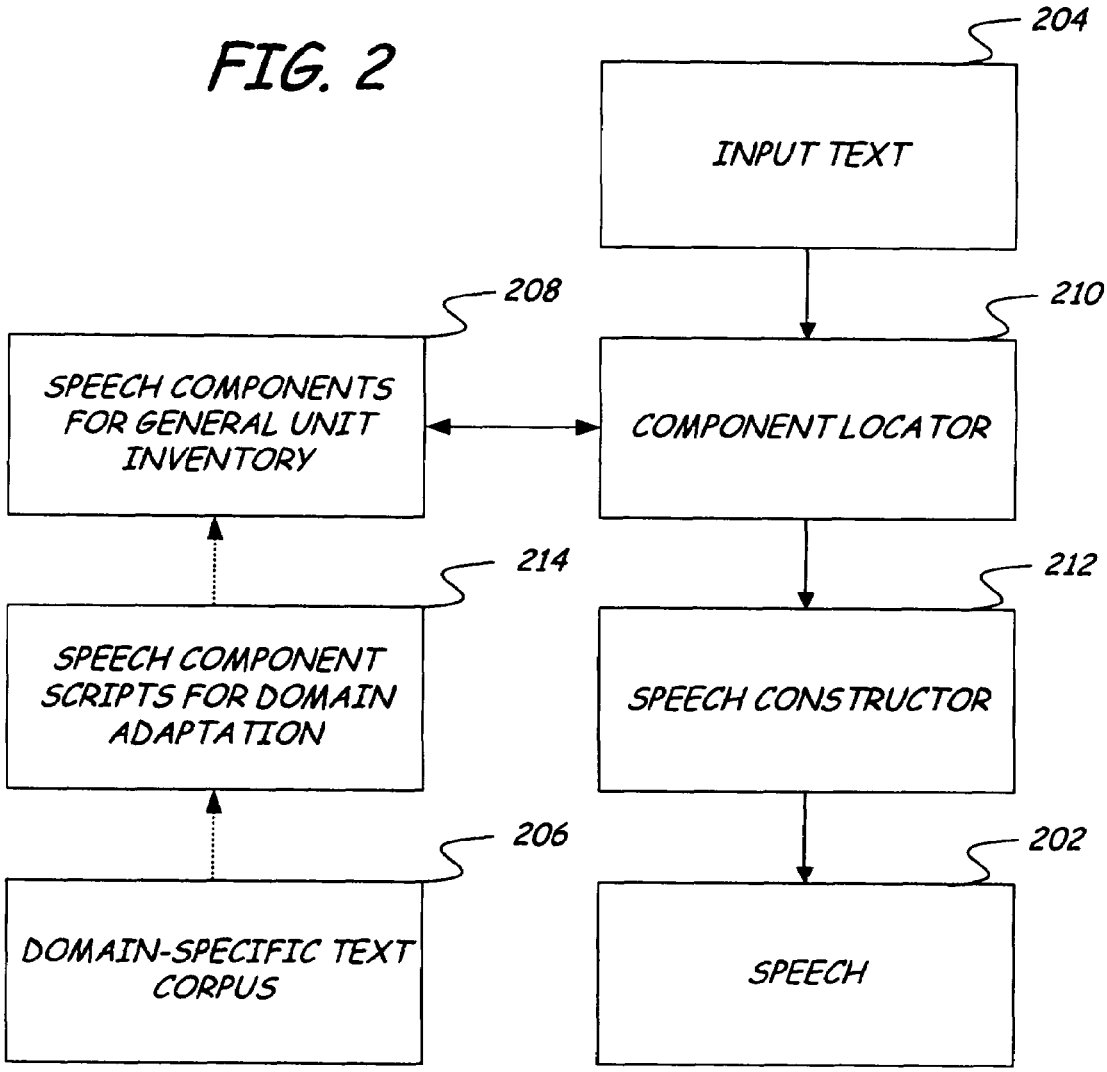
FIG. 2 is a block diagram of a corpus-driven general-purpose TTS system.

To assist in understanding the usefulness of the present invention, it may be helpful to provide a high-level overview of a general-purpose corpus-driven TTS system. Such a system is depicted in block form as system 200 in FIG. 2. System 200 is provided for exemplary purposes only and is not intended to limit the present invention.

System 200 is illustratively configured to construct synthesized speech 202 from input text 204. A speech component bank or unit inventory 208 contains speech components. In order to generate speech 202, a component locator 210 is utilized to match input text 204 with speech components contained in bank 208. Speech constructor 212 is then utilized to assemble the speech components selected from bank 208 so as to create speech 202 based on input text 204.

In accordance with one general aspect of the present invention, naturalness of speech 202 is improved through a system of selective domain adaptation of inventory 208. This domain adaptation is realized by adding optimized units of speech to bank 208. The optimized units to be added are illustratively based on scripts 214 that are automatically generated and derived from a target domain text corpus 206.

The core of the present invention, which will be described in detail below, involves at least three primary parts. The first part is an addition of domain-specific speech into the unit inventory of a corpus-driven TTS engine to improve the naturalness of synthetic speech on the target domain.

The second part is a measurement of the naturalness of synthetic speech on the target domain before and after adding domain-specific speech to the general unit inventory. The naturalness is illustratively measured in terms of Average Concatenative Cost (ACC) and Average Segment Length (ASL) in order to enable a determination as to estimated improvements in Mean Opinion Score (MOS). An estimated impact of the added domain-specific speech on naturalness can be determined even before the added speech is actually recorded.

The third part is a generation and utilization of an algorithm to generate a domain-specific script for recording speech. The script generation algorithm can include any of several proposed constraints. A first proposed constraint is a minimization of the amount of speech data to be recorded given a certain requirement on target ACC (or ASL, or estimated MOS). The amount of speech can be measured by the number of words (for alphabet languages such as English) or the number of characters (or Kanji) for Chinese or Japanese. A second proposed constraint is a minimization of ACC (or maximization of ASL or estimated MOS) for a given amount of speech to be recorded.

III. Theoretical Motivations for the Present Invention

In the last decade, concatenation based speech synthesis has been widely adopted and rapidly developed because of its potential of producing high quality speech. To some extent, speech synthesis becomes a problem of collecting, annotating, indexing and retrieval within large speech databases. The naturalness of synthesized speech depends to some extent on the size and coverage of the unit inventory. Though generally expanding the unit inventory is not an efficient way to increase naturalness for a general-purpose TTS, it is a reasonable method for increasing naturalness on a specific domain. Thus, the problem of domain adaptation is converted into a problem of generating an optimized script for collecting domain-specific speech. The sticking point of the problem is to find an efficient objective measure for naturalness.

A formal evaluation has been done to investigate the relationship between the naturalness of synthetic speech and some objective measures. The measurement ACC is shown to be highly correlated with MOS, which reveals that the ACC predicts, to a great extent, the perceptual behavior of human beings. Four hundred ACC vs. MOS pairs are plotted in FIG. 3. The linear regression equation at the top right corner of FIG. 3 can be used to estimate MOS from ACC. Objective measures for estimating naturalness of synthesized speech are described in a paper published at the 7th Eurospeech Conference on Speech Communication and Technology 2001 (Aalborg, Denmark—Sep. 3-7, 2001) entitled "AN OBJECTIVE MEASURE FOR ESTIMATING MOS OF SYNTHESIZED SPEECH," the paper being hereby incorporated by reference in its entirety.

Figure 4:
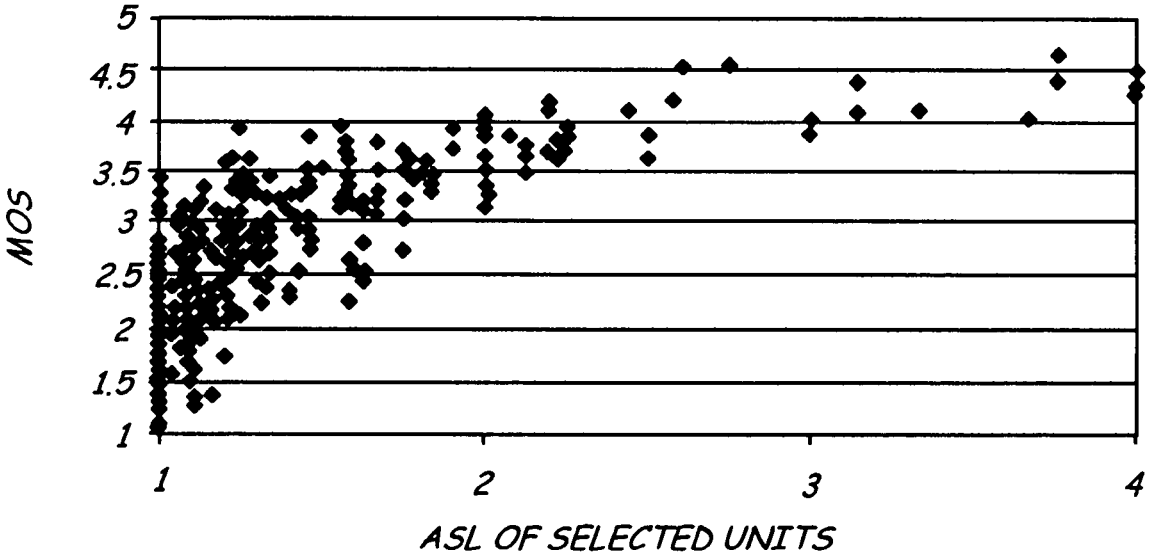
FIG. 4 is a plot of a relationship between Mean Opinion Score and Average Segment Length of selected units.

Several factors are considered when calculating ACC. Among them, smoothness cost proves to be a very important one. With this constraint, the longest speech segment that matches other prosodic and phonetic constraints should be selected for concatenation. Utterances concatenated by a few long segments often sound very natural. Thus, the Average Segment Length (ASL), defined as the average number of characters in selected segments, also reflects naturalness. The ASL vs. MOS pairs for 400 synthetic utterances are plotted in FIG. 4. Though the MOS of dots with ASL smaller than 1.5 scatters into a broad range, it concentrates around 3.5 when ASL increases to 2, and it goes above 4 when ASL exceeds 3.

The domain adaptation problem to be solved by embodiment of the present invention can be described as follows:

1. Definition of Symbols $C_s$: A domain-specific text corpus—Should be a good representation of the target domain—Naturalness of speech synthesized from this corpus is to be improved by adding some domain-specific speech to the general-purpose TTS system $U_g$: The scripts for the general unit inventory used by the general-purpose TTS engine $U_s$: Generated script(s) for domain adaptation $S_s$: The size of $U_s$ in number of sentences $L_g$: ASL for corpus $C_s$ when unit inventory $U_g$ is used $L_s$: ASL for corpus $C_s$ when $U_g+U_s$ is used 2. The problem For a given $S_s$, generate $U_s$ that maximizes $\Delta L=L_s-L_g$ IV. Specific Embodiments of the Present Invention In accordance with one aspect of the present invention, an automatic approach is provided for generating $U_s$. Generally speaking, the goal is to generate optimized script(s) $U_s$ that will provide maximum increase in ASL (and therefore perceived naturalness) within a size limitation $S_s$. Theoretically, the larger $S_s$ is, the larger the ASL will be. However, it is normally undesirable to spend too much time and energy on speech collection for specific domains. An automatic approach is proposed by embodiments of the present invention and relates to an extraction of Domain-Specific Strings (DSS) one by one according to their contribution to their increase in ASL. A stop threshold for $S_s$ and/or ASL can be selected according to a particular user's expectation of recording effort and naturalness.

Figure 3:
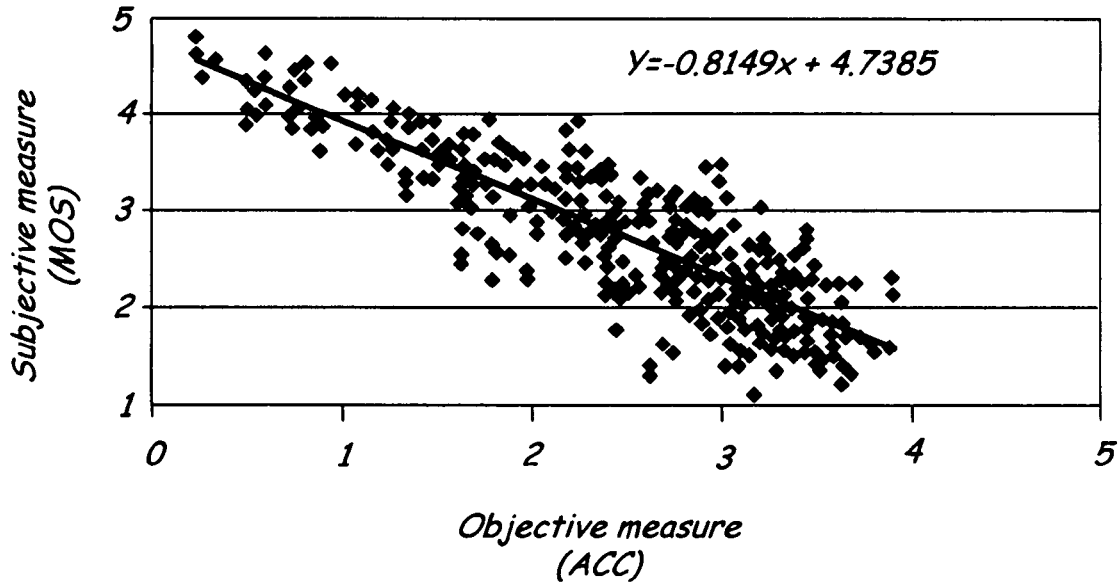
FIG. 3 is a plot of a relationship between a subjective measurement (Mean Opinion Score) and an objective measurement (Average Concatenative Cost).

ACC is proposed to be a good objective measure for naturalness of synthetic speech, from which MOS can be estimated (from the MOST-COST curve in FIG. 3). Thus, in accordance with one aspect of the present invention, to measure the performance of a general-purpose TTS engine on a specific domain, a text corpus that can represent the target domain is first collected. Corresponding speech waves need not be generated. The process for text-to-speech can illustratively stop after the concatenative cost for the text in processing is obtained. The ACC over the whole set of text are illustratively calculated. This value is then utilized to measure the naturalness of synthetic speech on the target domain directly, or MOS for that domain can be derived from the MOS-COST curve. The same procedure is then done before and after adding domain-specific speech into the unit inventory of the TTS system. The goal is to add a limited amount of speech data, while achieving the greatest decrease in ACC or increase in estimated MOS (ACC is negatively correlated with MOS).

Figure 5:
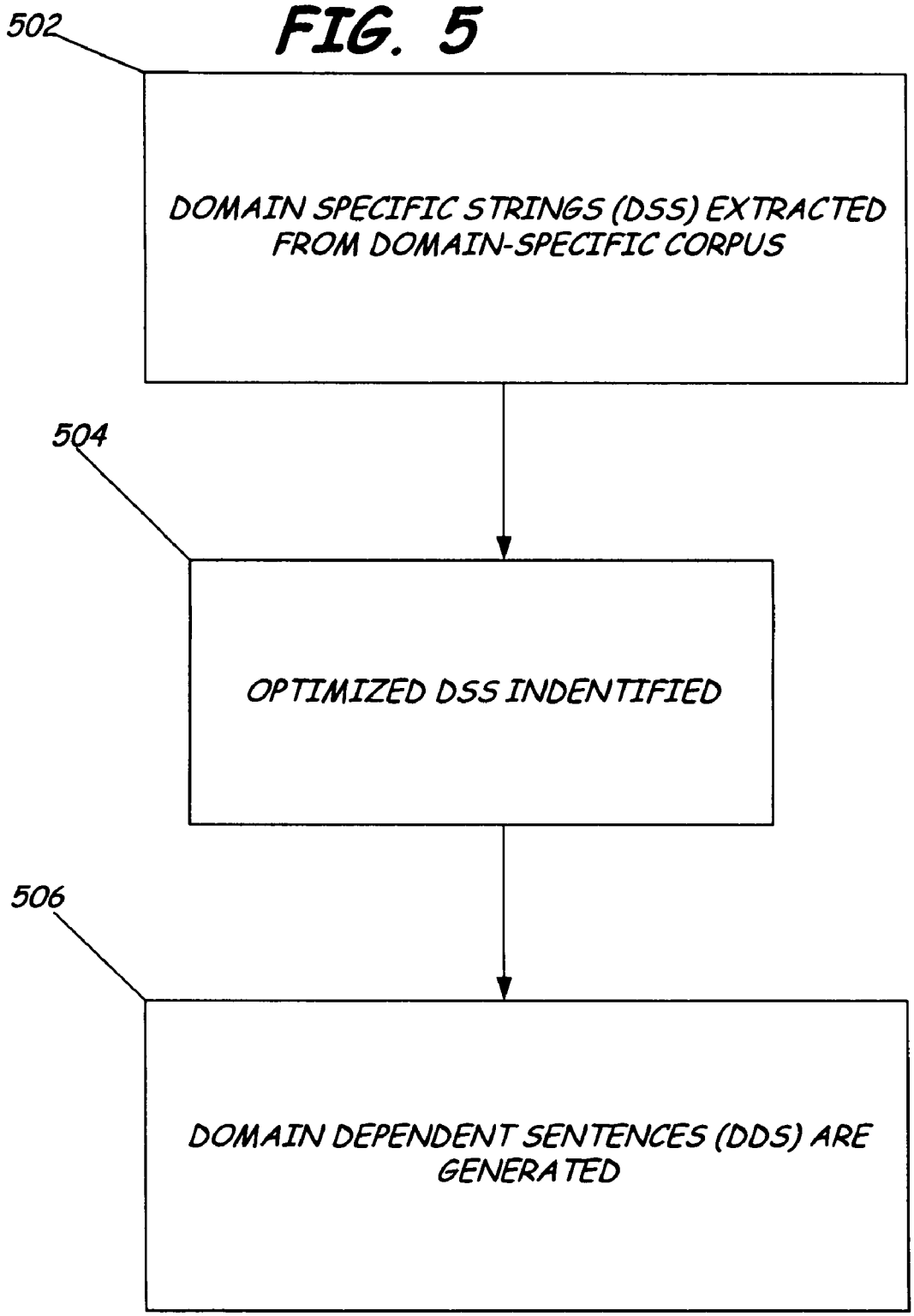
FIG. 5 is a general flow diagram for generation of domain-specific scripts.

A broad overview of a method of generating optimized script(s) $U_s$ is illustrated in FIG. 5. As is indicated by block 502, the first step is to extract Domain-Specific Strings (DSS) from $C_s$. A DSS is generally defined as a string of characters that appears frequently in $C_s$, yet never appears in $U_g$. A particular DSS can be a word, a phrase, or any part of a sentence.

In the DSS extraction step, all sentences in $C_s$ are assumed to be synthesized by concatenating sub-strings that appear in the unit inventory U. Among many possible schemes for sub-string selection, the one with the maximum ASL is assumed to be the most natural one. A Dynamic Programming (DP) based algorithm is presently proposed for finding the segmentation scheme with the minimum number of segments i.e., maximum ASL. Details of the algorithm will be described below. After finding the best string sequence for all sentences in $C_s$, the ASL for $C_s$, when U is used, is given by equation (1):

$$\mathrm{ASL}(C_s, U) = \mathrm{Size}(C_s)/\mathrm{Count}(\mathrm{Segment}, (C_s, U)) \quad (1)$$

where, Size ($C_s$) is the number of characters in corpus $C_s$, and Count (Segment, ($C_s$, U)) is the number of segments used to synthesize $C_s$ with U. Obviously, when a DSS (or a corresponding sentence that contains the DSS) is added into U, ASL($C_s$, U) will increase. An iterative algorithm is utilized to search for a DSS that will provide maximum increase in ASL($C_s$, U) one by one until a predetermined threshold for ASL, or a threshold for a predetermined number of DSS, is met. This optimization of DSS is reflected in at block 504 in FIG. 5.

In some instances it will be most desirable that DSS carry sentence level prosody. For example, it may be desirable to maintain sentence level intonation with regard to all DSS. Accordingly an optional step indicated by block 506 is performed in order to generate Domain Dependent Sentences (DDS) that include the extracted optimal DSS selected from $C_s$. Specific schemes for the generation of DDS, will be described in greater detail below.

Figure 6:
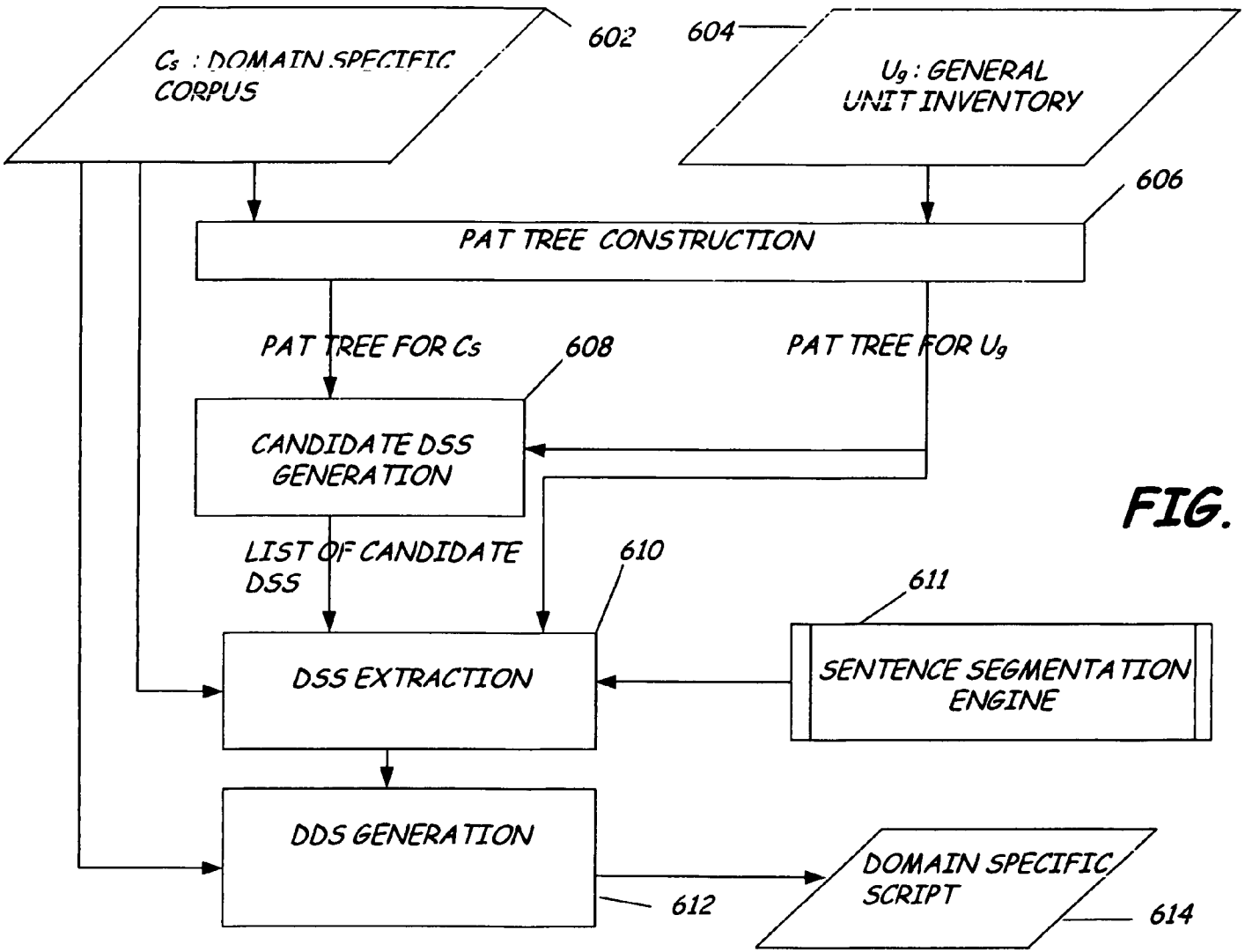
FIG. 6 is a more detailed flow diagram for generation of domain-specific scripts.

A detailed and specific flow diagram of an approach for generating domain-specific script is provided in FIG. 6. For calculating ASL over $C_s$, the operation of searching for a sub-string and its frequency of occurrence in $C_s$ and U is frequently used. In accordance with one embodiment of the present invention, an efficient indexing technique is utilized in this regard. In accordance with one in specific embodiment, a PAT tree is used to index both $C_s$ and $U_g$. Other indexing tools can be utilized without departing from the scope of the present invention. Blocks 602 and 604 represent $C_s$ and $U_g$ respectively. Block 606 represents creation of an indexing tool (i.e., PAT trees) for each of $C_s$ and $U_g$.

A PAT tree is an efficient data structure that has been successfully utilized in the field of information retrieval and content indexing. A PAT tree is a binary digital tree in which each internal mode has two branches and each external node represents a semi-infinite string (denoted as Sistring). For constructing a PAT tree, each Sistring in the corpus should be encoded into a bit stream. For example, GB2312 code for Chinese is used. Once the PAT tree is constructed, all Sistrings which appear in the corpus can be retrieved efficiently. In accordance with block 608, a list of candidate DSS is generated from the tree for $C_s$ by the criteria that candidate DSS should appear in $C_s$ for at least N times and they should never appear in $U_g$.

In accordance with block 610, to find the best DSS from all candidates, $C_s$ is segmented into substrings appearing in $U_g$ with the maximum ASL constraint. The problem is best illustrated in the context of a specific example:

EXAMPLE

Figure 7:
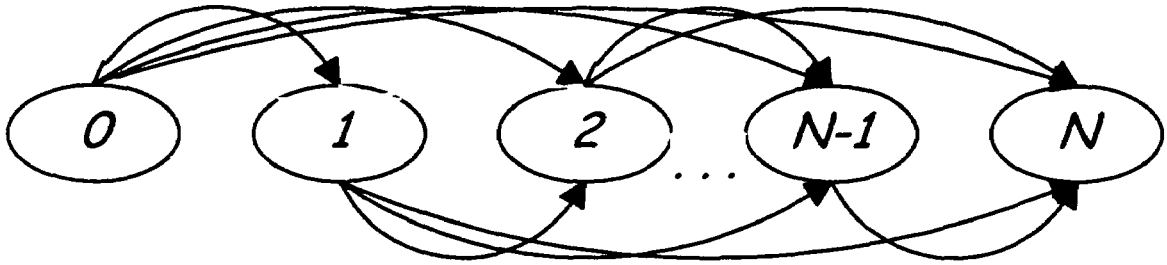
FIG. 7 is a schematic illustration of a system of networks for sentence segmentation.

A sentence with N Chinese characters is denoted as $C_1C_2 \ldots C_N$. It is to be segmented into M ($M \leqq N$) sub-strings, all of which should appear at least once in $U_g$. Though many segmentation schemes exist, only the one with the smallest M is what is searched for. In fact, it turns out to be a searching problem for the optimal path, which is illustrated under the DP framework in FIG. 7. Node 0 represents the start point of a sentence and nodes 1 through N represent character $C_1C_2 \ldots C_N$ respectively. Each node is allowed to jump to all the nodes behind it. The arc from node i to node j represents the sub-string $C_{i+1} \ldots C_j$. A distance d(i j) is assigned for it utilizing equation (2) below. Each path from node 0 to N corresponds to one segmentation scheme for stringing $C_1 \ldots C_N$. The distance for each path is the sum of the distances of all arcs on the path. Let f(i) denote the shortest distances from node 0 to i and g(i) keeps the nodes on the path with f(i). Then g (N) with f(N) is the optimal path.

$$d(i, j) = \begin{cases} 1 & \text{if } C_{i+1} \ldots C_j \text{ appears at least once in the unit inventory} \\ \infty & \text{otherwise} \end{cases} \quad (2)$$

$i \langle j$

The segmentation algorithm is described as follows:

Step 1: Initialization $f(0)=0, g(0)=-1$

Step 2: Recursion $f(j)=\min_{0 \leqq i<j}[f(i)+d(i,j)]$ $g(j)=\arg\min_{0 \leqq i<j}[f(i)+d(i,j)]$ for $j=1, 2, \ldots, N-1, N$ Step 3: Termination g(N) the path with shortest distance f(N) the distance for path g(N) (equivalent to the number of sub-strings on the path)

In accordance with block 610 in FIG. 6, DSS are extracted based on efficiency for increasing ASL. To measure the efficiency of a candidate DSS for increasing ASL, ASL Increase Per Character (ASLIPC) is illustratively defined by equation (3):

$$ASLIPC=(ASLa-ASLo)/L \quad (3)$$

where, L is the length of a candidate DSS in characters, $ASL_0$ is the ASL for $C_s$ when it is segmented by the unit inventory without current candidate DSS, and $ASL_a$ is the ASL after adding current candidate DSS into the unit inventory. Among the extracted DSS, some are sub-strings of the others. It is not necessary to keep them all. The shorter ones can be pruned under certain circumstances. For example, extracted DSS can be optionally eliminated if it is a part of a longer one. It should be noted that block 611 in FIG. 6 indicates a sentence segmentation engine utilized to facilitate the process of DSS extraction.

Figure 8:
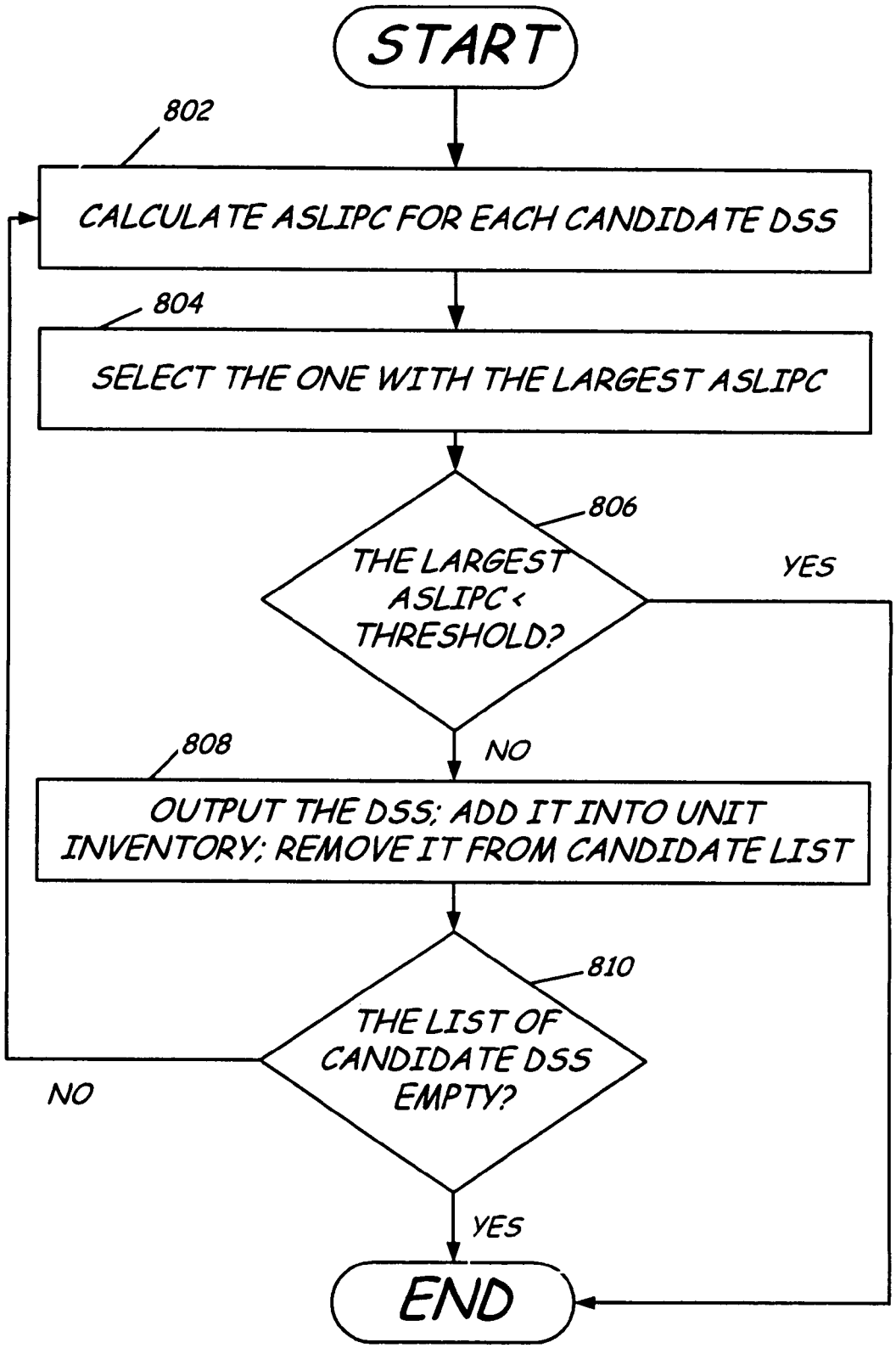
FIG. 8 is a flow diagram for extraction of domain-specific strings.

FIG. 8 is a flow diagram for extraction of domain-specific strings. Block 802 signifies the calculation of ASL Increase Per Character (ASLIPC) for each candidate DSS. A candidate DSS is illustratively a string of characters that does not appear in the general unit inventory but does appear a predetermined number of times in the domain-specific text corpus. Block 804 represents the selection of a candidate DSS having a maximized ASLIPC. Block 806 represents a determination of whether the largest ASLIPC associated with a candidate DSS is less than a predetermined threshold. If it is less than the threshold, then processing ends. If it is not less than the threshold, then the DSS is added to the unit inventory and removed from the candidate list. Again, shorter specific DSS's can optionally be eliminated if part of a longer string. In accordance with block 810, processing ends when the list of candidate DSS's is exhausted.

As was discussed above, once optimal DSS have been selected, in accordance with block 612, an optional step of DDS generation can be performed. Since sentences are sometimes preferred for speech data collections to carry sentence level prosody, DDS that cover all extracted DSS can be generated. Though they can be written manually, it is more efficient to select DDS from $C_s$ automatically.

All sentences in $C_s$ are considered as candidates for DDS generation. The criterion for selecting DDS is illustratively ASLIPC for a sentence, which is the sum of ASL increase for all DSS appearing in the sentence divided by the sentence length. The sentence with the highest ASLIPC is illustratively selected first and removed from the candidate list $C_s$. The DSS appearing in this sentence should be removed from the DSS list too. These procedures are illustratively done iteratively until the DSS candidate list is empty or the number of selected sentences reaches a predetermined limit. Block 614 in FIG. 6 represents the domain-specific script (DDS or DSS) that are the result of process completion. These domain-specific scripts are utilized to train a general-purpose TTS system to the target domain. When recording that corresponds to the domain-specific scripts is added into the general unit inventory, naturalness of synthetic speech for the target domain will increase.

V. Results of Experimentation

Experimentation performed in association with the present invention has shown that the amount of MOS increase to the general-purpose TTS system depends not only on the size of the training set and the size of the script for adaptation, but also on the broadness of the domain. Narrower domains have larger increases in MOS.

Figure 9:
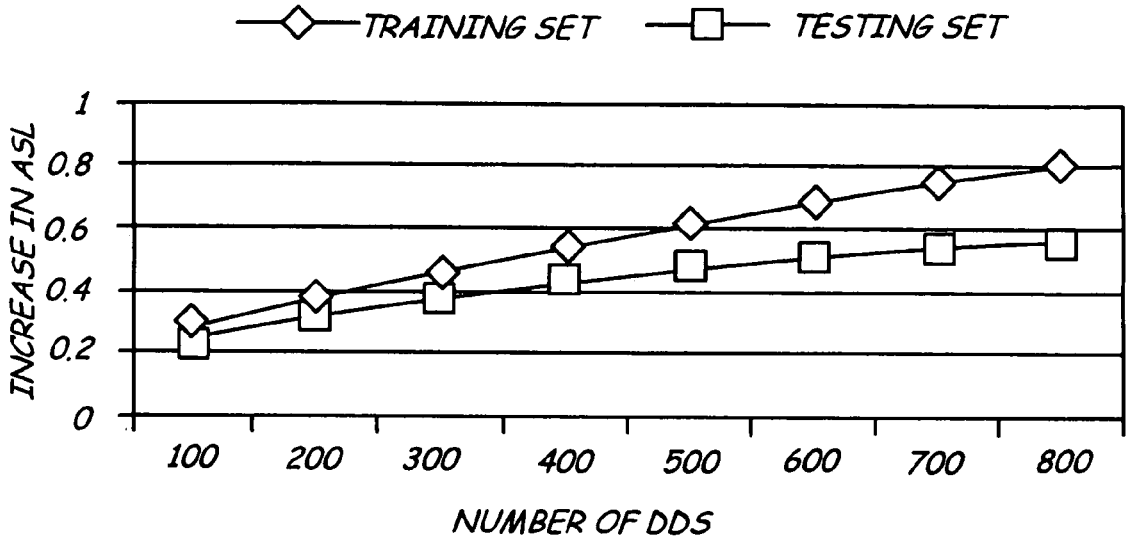
FIG. 9 is a graph representing a relationship between an increasing average segment length (ASL) and corresponding sizes of domain dependent sentences (DDS).

In accordance with a specific experiment, FIG. 9 is a graph representing a relationship between an increasing Average Segment Length and a quantity of Domain Dependent Sentences. The chosen domain was stock review. A 250 Kbyte corpus is used as a training set, from which DDS are extracted. Another 150 Kbyte corpus is used as a testing set to verify the extensibility of the selected DDS. ASL for the training and testing set before adaptation is 1.59 and 1.58 respectively. Increases in ASL after adaptation with 100 to 800 DDS for both sets are shown in the FIG. 9 graph. The ASL increase for the testing set is close to that for the training set when the number of DDS is small. Differences between the two sets go up rapidly after the number of DDS exceeds 500. There seems to be no absolutely best number of DDS to be extracted. A customized determination should be made as to a preferred balance point between size and naturalness.

Figure 10:
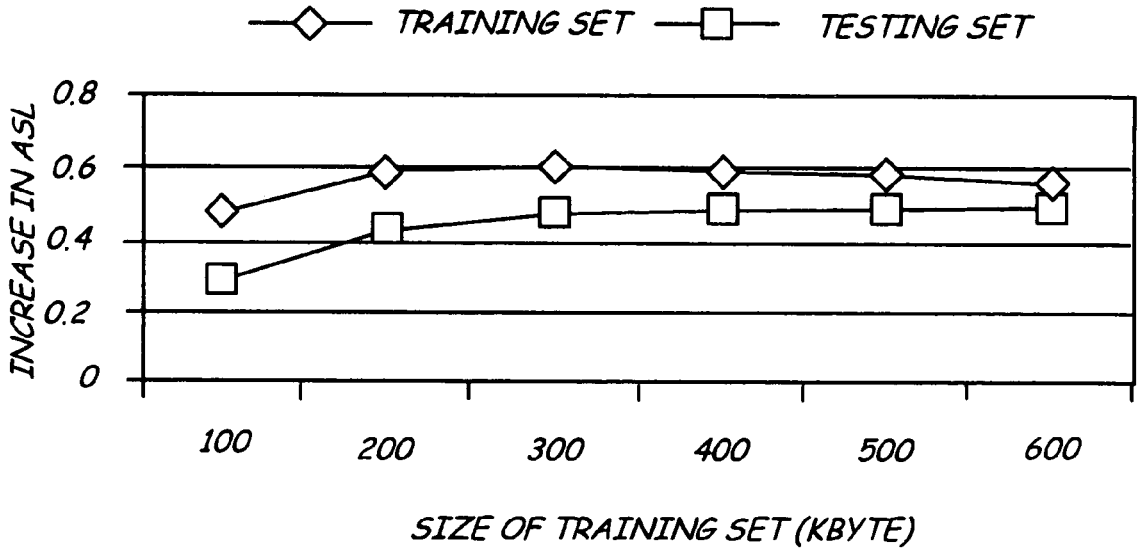
FIG. 10 is a graph representing a relationship between an increasing average segment length (ASL) and training sets of various sizes.

In accordance with another specific experiment, FIG. 10 is a graph representing a relationship between an increasing Average Segment Length and training sets of various sizes. The stock domain was used again in this experiment. The size of the training set was changed from 100K to 600K with a 100K step size. The testing set is the same as utilized in the FIG. 9 experiment. Five hundred DDS are extracted from each training set. Increases in ASL after adaptation are shown in FIG. 10. When the size of the training set exceeds 300K, the increase in ASL for the training set drops and the increase in ASL for the testing set goes fiat. The result shows that a 200K-300K training corpus is about as effective as any.

Figure 11:
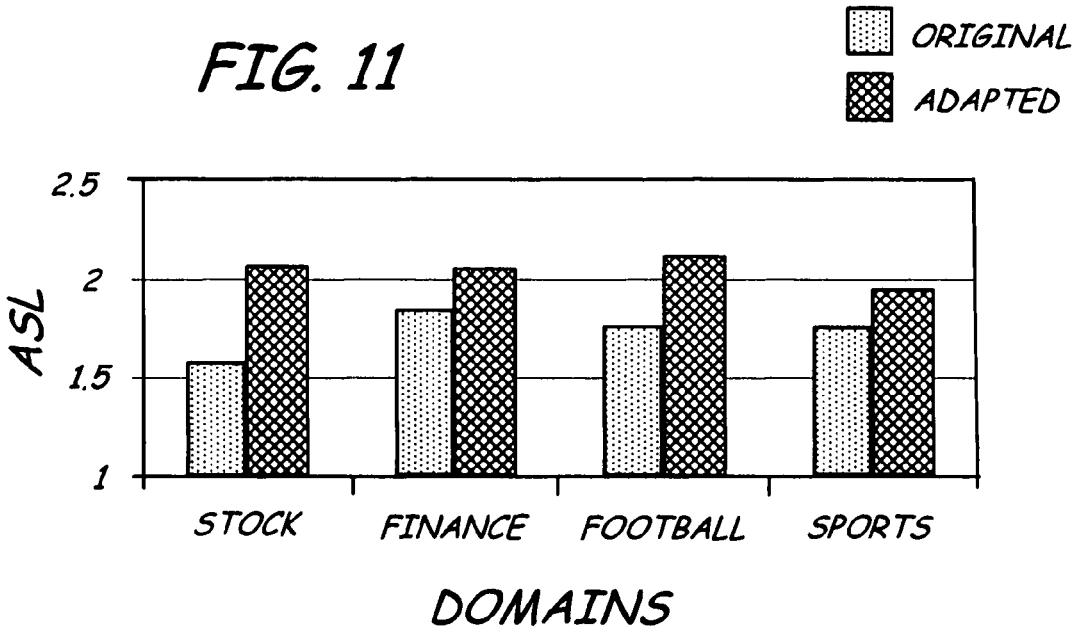
FIG. 11 is a chart representing a relationship between average segment length (ASL) and several specific domains before and after adaptation.

In accordance with another specific experiment, FIG. 11 is a chart representing a relationship between Average Segment Length and several specific domains before and after adaptation. To compare the performance on different domains, 500 DDS were extracted from 4 domains (stock review, finance news, football news and sports news) separately. The size for each training and testing set are 250K and 150K respectively. ASL for the testing set before and after adaptation are provided in FIG. 11. The original ASL for the four domains are different. Among them, the one for stock review is the smallest. This is due to the fact that few stock related corpora were used when generating the general unit inventory. After adapting with 500 DDS, increase in ASL for the two narrower domains (stock and football) are larger than those for the two broader domains (finance and sports).

Figure 12:
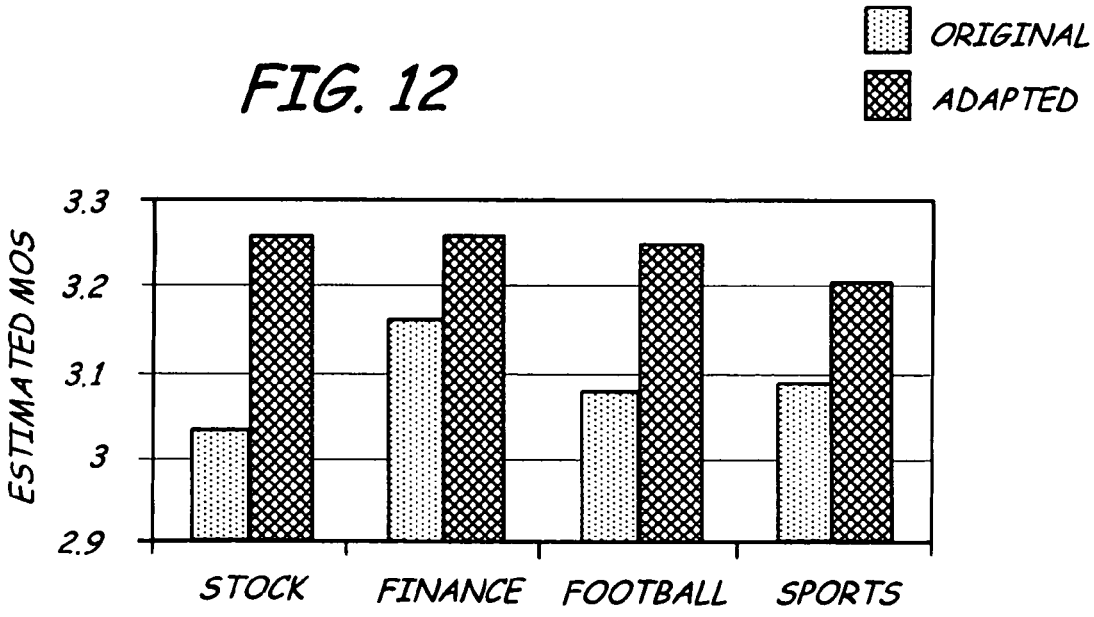
FIG. 12 is a chart representing a relationship between estimated mean opinion score (EMOS) and several specific domains before and after adaptation.

In accordance with another specific experiment, FIG. 12 is a chart representing a relationship between Estimated Mean Opinion Score and several specific domains before and after adaptation. In the DDS generation approach, ASL is the only constraint for unit selection. However, in a real TTS system, other constraints on prosody context and phonetic context are used. To clarify how much improvement is achieved on naturalness, the real unit selection procedure is used to calculate ACC before and after adaptation for the four domains. The corresponding MOS are estimated by the equation in FIG. 3 and they are shown in FIG. 12. The MOS for the four domains increases from 0.1 to 0.22 respectively. Since all features used for calculating ACC can be derived from texts, MOS after adaptation can be estimated without recording speech.

VI. Conclusion

The present invention presents a framework for generating domain-specific scripts. With it, application developers can estimate how much improvement can be achieved before starting to record speech for a specific domain. Experiments show that the extent of increase in naturalness depends on only on the size of the training set and the size of the script for adaptation, but also on the broadness of the domain. Greater increases in naturalness are observed for narrower domains.

Although the present invention has been described with reference to preferred embodiments, workers skilled in the art will recognize that changes may be made in form and detail without departing from the spirit and scope of the invention.

What is claimed is:

1. A method adapting a text-to-speech system, the method comprising:

supplying a domain-specific text corpus that corresponds to a target domain;

supplying a plurality of scripts that correspond to an inventory of speech units utilized by the text-to-speech system to synthesize speech;

generating a list of candidate domain-specific strings using text from the domain-specific text corpus, wherein each candidate domain-specific string occurs at least a predetermined number of times within the domain-specific text corpus, wherein the predetermined number is more than once;

generating a domain-specific script using said domain-specific string so as to include at least one domain-specific string included in the list of candidate domain-specific strings; and adapting the text-to-speech system based on the domain-specific script so as to improve the perceived naturalness of synthesized speech.

2. The method of 1, wherein each candidate domain-specific string does not occur within the plurality of scripts that correspond to the inventory of speech units.

3. The method of claim 1, further comprising identifying from the list of candidate domain-specific strings a first qualified domain-specific string that will maximize improvement of the naturalness of synthetic speech produced by the text-to-speech system on the target domain, wherein generating the domain-specific script comprises generating the domain-specific script so as to include the first qualified domain-specific string.

4. The method of claim 3, wherein identifying the first qualified domain-specific string comprises:

identifying the candidate domain-specific string that, if added to the plurality of scripts that correspond to the inventory of speech units, will maximize the average length of segments utilized by the text-to-speech system to synthesize speech.

5. The method of claim 3, wherein identifying the first qualified domain-specific string is done without recording speech for candidate domain-specific strings in the list.

6. The method of claim 3, wherein identifying the first qualified domain-specific string comprises:

measuring an average segment length before and after each candidate domain-specific string is added to the plurality of scripts that correspond to the inventory of speech units; and identifying the candidate domain-specific string that produces the greatest increase in average segment length.

7. The method of claim 3, wherein identifying the first qualified domain-specific string comprises:

measuring an average concatenative cost before and after each candidate domain-specific string is added to the plurality of scripts that correspond to the inventory of speech units; and identifying the candidate domain-specific string that produces the greatest decrease in average concatenative cost.

8. The method of claim 3, wherein identifying the first qualified domain-specific string comprises:

measuring a mean opinion score before and after each candidate domain-specific string is added to the plurality of scripts that correspond to the inventory of speech units; and identifying the candidate domain-specific string that produces the greatest increase in mean opinion score.

9. The method of claim 3, further comprising removing from the list of candidate domain-specific strings the first qualified domain-specific string.

10. The method of claim 9, further comprising:

repeating said identifying, generating and removing steps for additional qualified domain-specific strings until the list of candidate domain-specific strings is empty, or until the number of qualified domain-specific strings for which speech is added to the unit inventory reaches a predetermined limit.

11. The method of claim 3, further comprising removing from the list of candidate domain-specific strings those candidate domain-specific strings that are sub-strings of other candidate domain-specific strings.

12. The method of claim 3, further comprising removing from the list of candidate domain-specific strings those candidate domain-specific strings that are shorter than a predetermined length.

13. The method of claim 3, wherein generating the domain-specific script comprises generating a domain dependent sentence that includes the first qualified domain-specific string.

14. The method of claim 13, wherein generating the domain dependent sentence comprises manually writing the domain dependent sentence.

15. The method of claim 13, wherein generating the domain dependent sentence comprises selecting a sentence from the domain-specific text corpus.

16. The method of claim 15, wherein selecting a sentence from the domain-specific text corpus comprises selecting a sentence that, when added to the inventory of speech units utilized by the text-to-speech system to synthesize speech, will maximize the average length of segments.

17. The method of claim 15, wherein selecting a sentence from the domain-specific text corpus comprises selecting a sentence that, when added to the inventory of speech units utilized by the text-to-speech system to synthesize speech, will maximize the mean opinion score.

18. The method of claim 15, wherein selecting a sentence from the domain-specific text corpus comprises selecting a sentence that, when added to the inventory of speech units utilized by the text-to-speech system to synthesize speech, will minimize the average concatenative cost.

19. A method for generating a domain-specific script for domain adaptation of a text-to-speech system, the method comprising:

supplying a domain-specific text corpus that corresponds to a target domain;

supplying a plurality of scripts that correspond to an inventory of speech units utilized by the text-to-speech system to synthesize speech;

generating a list of candidate domain-specific strings using text from the domain-specific text corpus, wherein each candidate domain-specific string occurs a predetermined number of times within the domain-specific text corpus, where in the predetermined number of times is more than once;

selecting from the list, based on an objective criteria, a limited number of candidate domain-specific strings that, if added to the plurality of scripts that correspond to the inventory of speech units, will the naturalness of synthetic speech produced by the text-to-speech system on the target domain;

generating a domain-specific script so as to include the limited number of candidate domain-specific strings; and adapting the text-to-speech system based on the domain-specific script so as to improve the perceived naturalness of synthesized speech.

20. The method of claim 19, wherein selecting from the list a limited number of candidate domain-specific strings comprises:

selecting from the list a limited number of candidate domain-specific strings that, if added to the plurality of scripts that correspond to the inventory of speech units, will raise an average length of all segments included in the plurality of scripts.

21. The method of claim 19, wherein selecting from the list a limited number of candidate domain-specific strings comprises:

selecting from the list a limited number of candidate domain-specific strings that, if added to the plurality of scripts that correspond to the inventory of speech units, will raise a mean opinion score associated with the plurality of scripts.

22. The method of claim 19, wherein selecting from the list a limited number of candidate domain-specific strings comprises:

selecting from the list a limited number of candidate domain-specific strings that, if added to the plurality of scripts that correspond to the inventory of speech units, will lower an average concatenative cost associated with the plurality of scripts.

* * * * *

UNITED STATES PATENT AND TRADEMARK OFFICE

CERTIFICATE OF CORRECTION

PATENT NO. : 7,328,157 B1
APPLICATION NO. : 10/350850
DATED : February 5, 2008
INVENTOR(S) : Min Chu et al.

It is certified that error appears in the above-identified patent and that said Letters Patent is hereby corrected as shown below:

In column 2, line 7, after “corpus” insert -- into a --.

Signed and Sealed this
Twenty-sixth Day of April, 2011

David J. Kappos

David J. Kappos
*Director of the United States Patent and Trademark Office*